US007044190B2

(12) United States Patent
Nakai et al.

(10) Patent No.: US 7,044,190 B2
(45) Date of Patent: May 16, 2006

(54) SUBLIMATION PATTERN CASTING METHOD

(75) Inventors: Shigeo Nakai, Aichi (JP); Masahiko Kagitani, Aichi (JP); Yoshimasa Takagi, Tochigi (JP); Takeshi Narushima, Tochigi (JP); Hitoshi Funada, Aichi (JP)

(73) Assignee: Kao Corporation, Tokyo (JP)

( * ) Notice: Subject to any disclaimer, the term of this patent is extended or adjusted under 35 U.S.C. 154(b) by 79 days.

(21) Appl. No.: 10/416,541

(22) PCT Filed: Nov. 21, 2001

(86) PCT No.: PCT/JP01/10181

§ 371 (c)(1),
(2), (4) Date: Nov. 3, 2003

(87) PCT Pub. No.: WO02/42022

PCT Pub. Date: May 30, 2002

(65) Prior Publication Data

US 2004/0060681 A1 Apr. 1, 2004

(30) Foreign Application Priority Data

Nov. 24, 2000 (JP) ..... 2000-357845

(51) Int. Cl.
*B22C 9/04* (2006.01)

(52) U.S. Cl. ..... 164/34; 164/45

(58) Field of Classification Search ..... 164/34, 164/35, 45

See application file for complete search history.

(56) References Cited

U.S. PATENT DOCUMENTS 4,865,112 A * 9/1989 Schwarb et al. ..... 164/34
5,524,696 A * 6/1996 Osborne et al. ..... 164/34

FOREIGN PATENT DOCUMENTS

JP 62-207530 * 9/1987
JP 5-261470 A 10/1993
JP 8-206777 A 8/1996
JP 11-90583 A 4/1999
JP 2003-334634 * 11/2003

* cited by examiner

*Primary Examiner*—Len Tran
(74) *Attorney, Agent, or Firm*—Birch, Stewart, Kolasch & Birch, LLP

(57) ABSTRACT

Provided is an evaporative pattern casting process which ensures that smooth casting can be carried out without blow-back of a molten metal and a molding product having an excellent casting quality is obtained. The invention relates to an evaporative pattern casting process for casting a product, which comprises pouring a molten metal into a mold provided with a pattern with a through-hole, embedded in molding sand, and evaporating the pattern with the poured molten metal, gradually exhausting the gas generated by the evaporation of the pattern to the outside of the mold through an exhausting path provided with an exhaust gas-controlling means.

16 Claims, 2 Drawing Sheets

SUBLIMATION PATTERN CASTING METHOD

This application is the national phase under 35 U.S.C. § 371 of PCT International Application No. PCT/JP01/10181 which has an International filing date of Nov. 21, 2001, which designated the United States of America.

FIELD OF THE INVENTION

The present invention relates to an evaporative pattern casting process, in particular an evaporative pattern casting process for carrying out casting by exhausting gas generated from the evaporative pattern to the outside of the pattern through an exhausting path.

PRIOR ART

An evaporative pattern casting process which is also called a full mold casting process is a casting process in which generally an evaporative pattern made of an expandable polystyrene or the like is embedded in a molding sand, a molten metal is poured into the pattern to vaporize and to evaporate the evaporative pattern by the heat of the molten metal and also a molten metal is filled in the generated gap, thereby making a molded article. This process is widely used for manufacturing, particularly, a press die.

The evaporative pattern casting process has many advantages such as the capability of casting into an exact form. It has however, on the contrary, the drawbacks that casting defects are easily caused by defective degassing control, the strength of the model is low and therefore it is easily deformed and damaged so that sand cannot be filled strongly, leading to unsatisfactory packing density, resulting in insufficient pattern strength and causing burning fusion.

As techniques concerning degassing, a method is disclosed in the publication of Japanese Patent Application Laid-Open (JP-A) No. 5-261470 in which an air passage communicated with an exhaust port is formed inside of an evaporative pattern. Also, a method is disclosed in the publication of JP-A No. 8-206777 in which generated gas is forcedly exhausted externally through molding sand with sucking external gas. Moreover, a full-mold casting method is disclosed in the publication of JP-A No. 11-90583 which can smoothly exhaust generated gas out of a pattern.

However, in such a method intending to obtain casting products with small defects by efficiently exhausting the gas generated from an evaporative pattern to the outside as disclosed in each publication of JP-A Nos. 5-261470, 8-206777 and 11-90583, the distribution of pressure of the gas layer created in the pattern becomes so large that the molten metal is blown up along the gas passage because the exhaust speed of the combustion gas is too high. As a result, there is the case where the molten metal is largely disturbed in the pattern so that the carbon residue and the generated gas are involved in the molten metal, which promotes the generation of defects.

DISCLOSURE OF THE INVENTION

It is an object of the present invention to provide an improved evaporative pattern casting process enabling production of a high quality casting product with small carbon residue defects by controlling a pressure distribution of gas in the mold.

The invention relates an evaporative pattern casting process for casting a product, which comprises pouring a molten metal into a mold provided with a pattern with a through-hole embedded in molding sand, and evaporating the pattern with the poured molten metal, gradually exhausting the gas generated by the evaporation of the pattern to the outside of the pattern through an exhausting path provided with an exhaust gas-controlling means.

The invention further relates to a method of preventing the molten metal from being disturbed, which comprises pouring a molten metal into a mold provided with a pattern with a through-hole embedded in molding sand, and evaporating the pattern with the poured molten metal, gradually exhausting the gas generated by the evaporation of the pattern to the outside of the pattern through an exhausting path provided with an exhaust gas-controlling means.

Figure 1:
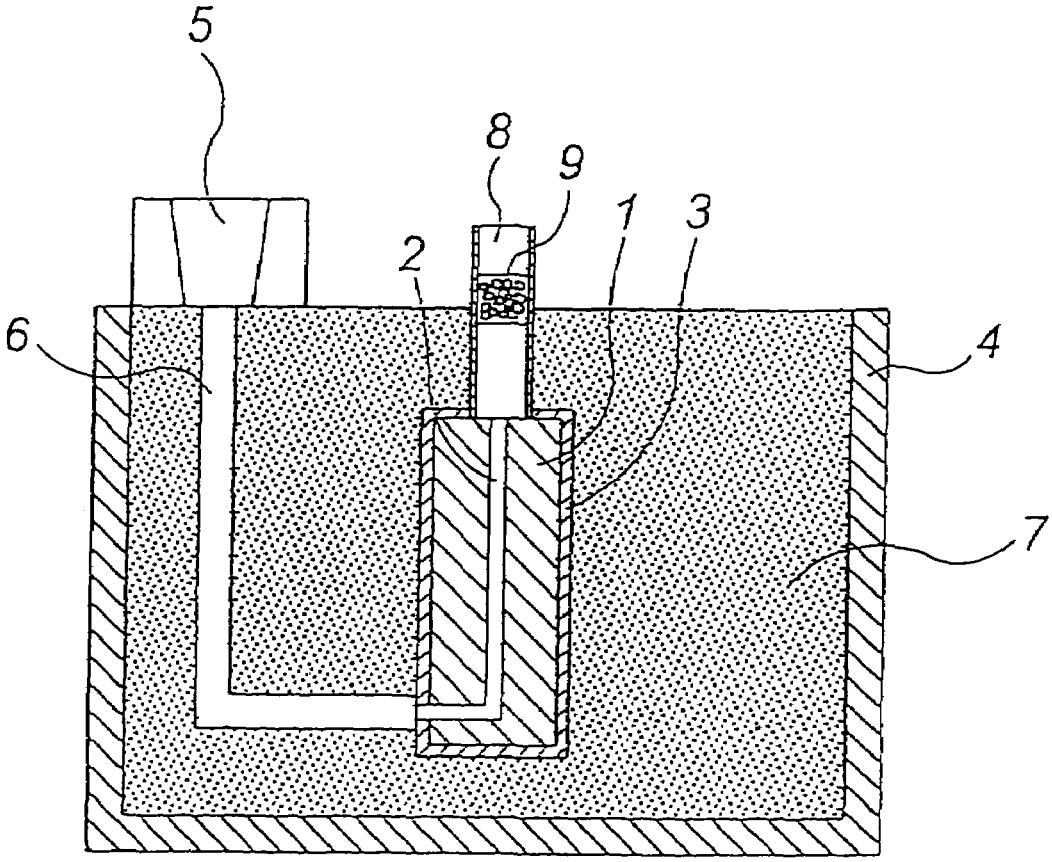
FIG. 1 is a schematic view showing one example of the evaporative pattern casting process according to the present invention.

In these figures, reference numeral 1 represents a pattern, 2 represents a through-hole, 8 represents an exhausting path and 9 represents refractory particles.

DETAILED DESCRIPTION OF THE INVENTION

The evaporative pattern casting process according to the present invention will be explained with reference to FIG. 1. The mold comprises a molding flask 4, a pattern 1 embedded in molding sand 7 filled in the molding flask 4 and the like. A sprue 5 communicated with the pattern 1 is disposed on the left upper side. The pattern 1 is made of an expanded polystyrene and into the same shape as a product and is provided with a through-hole 2. The molding sand 7 is silica sand (AFS–GFN=50) and is made to contain an appropriate amount of a binder. In the formation of the pattern, first a coating material 3 having a high heat resistance is applied to the surface of the pattern 1 and then dried sufficiently. After a runner 6 is formed in the molding flask 4, the pattern 1 is secured and embedded in the molding sand 7. Then the sprue 5 is installed. In this case, the inside of the through-hole 2 is left vacant as an exhausting pipe communicated with the through-hole 2, being installed as an exhausting path 8. The exhausting pipe for the exhausting path 8 is made of ceramics, filled with refractory particles 9 such as alumina molded with a binder as the exhaust gas-controlling means and embedded in the molding sand 7 so that the through-hole 2 may be communicated with air.

When a molten metal is poured from the sprue 5, the molten metal melts the pattern land remains in the pattern. Meanwhile, the gas from the pattern 1, melted and combusted by the molten metal, will be observed exhausting from the exhausting path 8. Since the refractory particles have been filled in the exhausting path 8, the gas is gradually exhausted.

In the present invention, the gas (hereinafter referred to as "generated gas") generated by the combustion and evaporation of the pattern is gradually exhausted to the outside of the model in this manner. Here, the term "be gradually exhausted" means that the generated gas is not forcedly exhausted almost at the same time as generation, but is exhausted gradually under controlling the amount of the gas. The disturbance of the molten metal in the model can be controlled by exhausting the generated gas gradually out of the mold in this manner. Also, the exhaust gas-controlling means implies a means provided with a ventilation enabling the aforementioned gradual exhausting by the provision of this means. Examples of the exhaust gas-controlling means include refractory particles, a layer of the refractory particles, a back pressure valve, a hollow fine tube or the like. Refractory particles, the layer of the refractory particles and the back pressure valve are preferable from the viewpoint of preventing the molten metal from being spurted and from the quality of a cast product.

Figure 2:
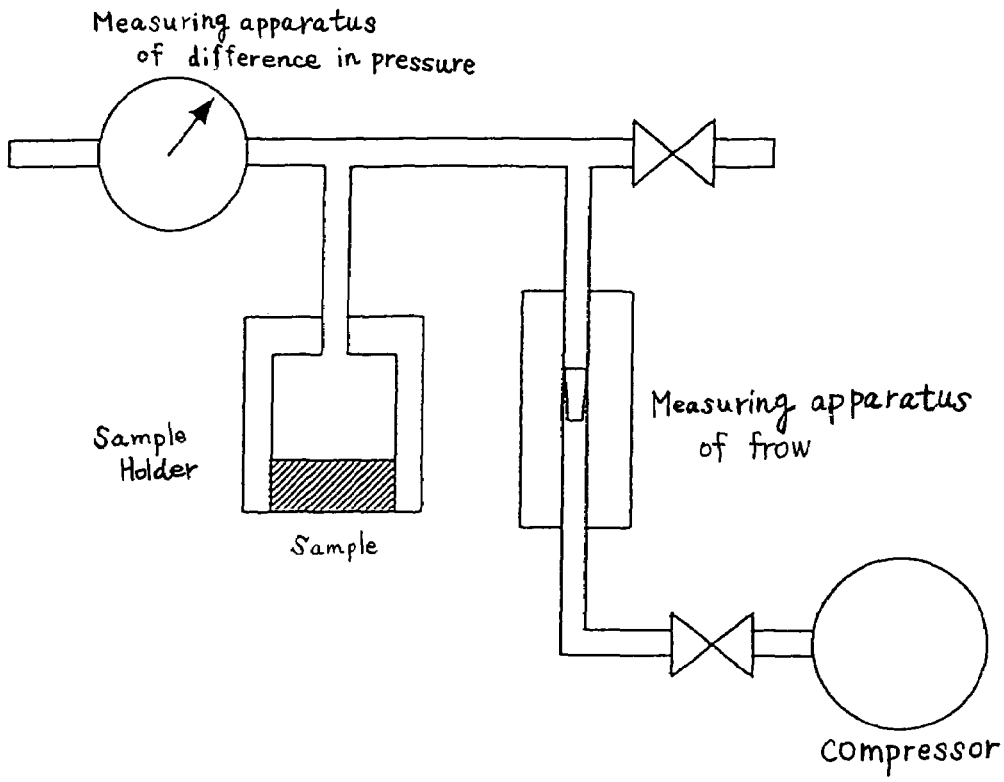
FIG. 2 is a schematic view showing a method of measuring ventilation resistance.

In the present invention, a first pressure loss (calculated value) of the gas passed through the exhausting path is preferably 0.05 to 5000 g/cm$^2$, more preferably 0.1 to 1000 g/cm$^2$, still more preferably 0.5 to 100 g/cm$^2$, particularly preferably 1 to 50 g/cm$^2$. Here, the pressure loss means a difference in pressure between before and after the exhaust gas-controlling means (upstream and downstream of the gas passage). Although no particular limitation is imposed on the pressure of the exhaust side of the exhausting path, the pressure is preferably the atmospheric pressure. The first pressure loss (calculated value) may be found by calculation according to the following procedure. First, as shown in FIG. 2, pressures are determined when pressure air flows from a compressor with changing the quantity of airflow (usually in the range of from 1 to 10 L/min.) and a calibration curve is made based on these data. The quantity of the generated gas (L/min.) per unit time is found from pouring time and a predicted quantity V of the generated gas. Then, the calibration curve is applied to the quantity of gas by preliminarily approximate extrapolation to thereby find the first pressure loss (calculated value).

Here, according to "CASTING, FORGING AND HEAT TREATMENT" in August, 1995, page 27, FIG. 3, the generated quantity of thermally decomposed gas at 1000° C. is 650 cm 3/g in the case of a polystyrene and 980 cm$^2$/g in the case of a polymethylmethacrylate. When using materials other than these exemplified materials, V is found by measurement. This first pressure loss (calculated value) can be advantageously determined with a simple testing.

Also, in the present invention, a second pressure loss (actual value) of the gas passing through the exhausting path is preferably 0.5 to 5000 g/cm$^2$, more preferably 5 to 1000 g/cm$^2$ particularly preferably 10 to 500 g/cm$^2$. This second pressure loss (actual value) is the maximum value obtained when a change in pressure at the entrance side of the exhaust gas-controlling means is measured by a pressure gage (gage pressure). The test of this second pressure loss (actual value) is more difficult than that of the first pressure loss. However, the second pressure loss has an advantage that it has a high correlation with the quality of a cast product.

Also, when the exhaust gas-controlling means is constituted by filling a refractory material, specifically, in the case where the exhaust gas-controlling means is constituted of an refractory material layer, a first degree of ventilation (the value calculated from the quantity of airflow extrapolated from a calibration curve) in the exhaust gas-controlling means is preferably 0.5 to 2000, more preferably 5 to 1000 and particularly preferably 50 to 800. The ventilation level is measured according to JACT Test Method M-1 "Test method of the degree of ventilation". In this test method, the degree of ventilation is calculated according to the following formula: $(V\times h)/((P\times A\times t)$. In the present invention, V is the quantity of the thermally decomposed gas (cm$^3$) to be generated which quantity is calculated from the aforementioned extrapolation from the calibration curve, h is the thickness (cm) of the refractory material or the like to be filled, P is the first pressure loss (g/cm$^2$) of the exhaust gas in the exhausting path (calculated value), A is the sectional area (cm$^2$) of the exhausting path and t is pouring time (sec).

Moreover, in the present invention, it is desirable to use exhaust gas-controlling means of which a second degree of ventilation (calculated value at an air flow rate of 2 L/min.) is 100 to 10,000,000, further 200 to 1,000,000, particularly 250 to 500,000 and still particularly 300 to 100,000. This second degree of ventilation is a degree of ventilation when the airflow rate is set to 2 L (2000 ml)/min. and is given by the formula, $2000\times h/(P\times A)$.

As the refractory material layer which is permeable, for example, a refractory one molded by adding a binder or the like to a refractory particle and a so-called ceramics foam filter obtained by dipping a urethane foam in a ceramics slurry, followed by burning may be used. The former type is preferable. The average particle diameter of the refractory particles is preferably 0.1 to 10 mm and more preferably 0.5 to 5 mm. Examples of the refractory material particle include particles of metals or oxides thereof, such as alumina, silica sand, zircon sand, chromite sand and synthetic ceramic sand. The refractory material is preferably filled in such an amount that its thickness is 0.5 to 20 cm and further 1 to 10 cm though the amount depends on the area and shape of the exhausting path.

Also, the back pressure valve means a valve which makes it possible to set the pressure of gas in a flow direction to a level lower at the front side (upstream of a gas passage) of the valve than at the rear side (downstream of the gas passage) of the valve. As this valve, any one of a spring type low-pressure valve, a needle type and the like may be used. The exhaust gas-controlling means is formed by providing the aforementioned measures in the exhausting path.

The diameter, installation position and, the number of the exhausting pipes which is to be the exhausting path, and the like are decided according to the shape and size of the pattern. The exhausting path is preferably formed of a cylinder-like and preferably ceramic exhausting pipe having a diameter of 30 cm or less and preferably 1 to 10 cm. Although the number of the exhausting pipes may be optionally determined so as to be able to secure a desired degree of ventilation, it is preferable to install one pipe per 1000 to 100,000 cm$^3$ and preferably 1000 to 10,000 cm$^3$ of the expanded material.

In the case of using a hollow fine tube as the exhaust gas-controlling means, the tube may be disposed such that it is in contact with the pattern. The hollow tube may be used as the exhausting path, too. The hollow fine tube has an inside diameter of 0.1 to 5 cm and a length of 30 cm to 5 m and preferably has an inside diameter of 0.5 to 2 cm and a length of 40 cm to 2 m. The hollow fine tube is preferably a type constituted of a refractory material such as a metal.

The pattern may be made of an expandable synthetic resin. The expandable synthetic resin may be an expandable material of polystyrene, methylpolymethacrylate or a copolymer thereof.

The pattern is provided with the through-hole formed therein. As shown in FIG. 1, it is preferable to form the exhausting path 8 provided with the exhaust gas-controlling means and/or a through-hole communicated with the runner 6. In order to exhaust the thermally decomposed gas gradually under fine control, it is necessary to introduce the gas collectively into the exhaust gas-controlling means. For this, the pattern is more preferably provided with a through-hole communicated with the exhausting path and the runner. The through-hole may be formed when producing the pattern or by using a heated metal bar or the like or a drill or a laser after the pattern is formed or may be formed by applying an adhesive tape to the surface of the pattern after a notch is formed using a cutter knife or the like. The diameter, formation position and the number of the through-holes and the like are decided according to the shape and size of the pattern. In the case where the through-hole can be formed only at a position which is not communicated with the molten metal and the exhausting path because of limitations from, for example, the means forming the through-hole and from the shape of the pattern, it is preferable to form the through-hole at a position possibly closest to the runner and the exhausting path.

The pattern is provided with a coating layer formed using a coating material. Because, in the present invention, it is less necessary to exhaust gas through the coating film, it is possible to use, besides commercially available products, those containing refractory aggregates having a fine particle diameter as small as 10 μm or less and preferably 1 to 10 μm which cannot be usually used in a conventional full mold casting process. As this ensures that the surface smoothness of the coating film is improved, the surface smoothness of a cast product is also improved. Conventionally, if a coating material containing refractory aggregates having a fine particle diameter is used for evaporative pattern casting process, the permeability of a coating film is dropped and increases in carbon residue defects and gas defects are seen. However, in the evaporative pattern casting process of the present invention, such problems are solved. Also, the sand compaction can be improved using refractory particles having a large particle diameter (1 mm or more) with a highly strong coating film formed by a coating layer being 2 to 10 mm thick. Examples of the refractory aggregate in the coating material include graphite, zircon, magnesia, alumina and silica. As a binder for the coating material, it is preferable in view of coating strength to add an aqueous type binder including a water-soluble polymer such as sodium polyacrylate, starch, methyl cellulose, polyvinyl alcohols, sodium alginate or gum arabic or an emulsion of any resin such as vinyl acetate types or also an alcohol type binder including an alcohol-soluble or alcohol-dispersible resin. The additive amount of the binder is preferably 0.5 to 10 parts by weight based on 100 parts by weight of the refractory aggregates.

As the molding sand used for casting, new or reclaimed sand is used, which maybe zircon sand, chromite sand, synthetic ceramic sand or the like besides silica sand having silica material as its major component is used. The molding sand may be used without adding any binder. In this case, better sand compaction is obtained. However, where strength is required, it is preferable to add the binder and to harden using a hardener.

In the process of the present invention, casting can be carried out while suppressing the molten metal disturbance as the generated gas is gradually exhausted to the outside when molten metal is poured. It is considered that, because a back pressure adaptable to the pouring of the molten metal, preferably at such a level as to achieve the aforementioned first and second pressure losses, is loaded using the exhaust gas-controlling means having the first and second degrees of ventilation, both prevention of the generation of molten metal disturbance (e.g., blow-back of the molten metal during casting) and rapid pouring of the molten metal are attained.

In the present invention, the generated gas is not forcedly exhausted, but gradually exhausted. Therefore, the pressure distribution of the gas layer in the mold becomes smaller and carbon residue defects can be decreased more significantly in the process of the present invention than in a conventional method.

As a further effect, gas exhausting ability is controlled more exactly in the process of the present invention than in a conventional full mold casting process and therefore, a blow-back phenomenon during casting and the blowup of the molten metal from the gas exhaust port are restricted, leading to an improvement in working safety.

Also, unlike a conventional full mold casting process, the process of the present invention is decreased in the necessity of exhausting gas through the coating film. Therefore, the surface smoothness of a cast can be improved using a coating material containing refractory aggregates having a fine particle diameter and a thick coating layer can be formed to provide high strength to the coating film.

EXAMPLES

Example 1

A through-hole 2 was formed in a 120 mm×80 mm×250 mm-H foamed pattern 1 (made of an expanded polystyrene) by using a heated metal bar having a diameter of 3 mm as shown in FIG. 1. The diameter of the through-hole was about 4 mm.

A 2-mm-diameter spherical alumina 9 mixed with an ester-curable phenol resin was filled in a 4-cm-diameter cylindrical ceramic tube (length: 30 cm) such that the thickness (h) of alumina 9 in layer was 2.5 cm and cured, to form an exhausting path 8.

With regard to this exhausting path 8, pressure loss P was measured as shown in FIG. 2. As a result, P=0.02 g/cm$^2$ when air ventilation rate was 1 L/min., P=0.08 g/cm$^2$ when air ventilation rate was 3 L/min. and P=0.15 g/cm$^2$ when air ventilation rate was 5 L/min. In this example, pouring time (t) was set to 10 seconds and therefore the quantity of gas to be exhausted was about 172 L/min. The first pressure loss was 6 g/cm$^2$ when the quantity of gas was 172 L/min.

The weight of the foamed pattern 1 in this example was 44 g. From the data of polystyrene as to the quantity of thermally decomposed gas to be generated at 1000° C. in the aforementioned document, the quantity V of the thermally decomposed gas to be generated from this foamed pattern was 28600 cm$^3$ and the quantity of the gas to be exhausted was calculated at 28.6 L/10 sec.≈172 L/min.

From the above, V=28600 cm$^3$, h=2.5 cm, P=6 g/cm$^2$, A=12.6 cm$^2$ (3.14×2×2) and t=10 sec., and the first degree of ventilation in the spherical alumina-filled layer which was exhaust gas-controlling means was given by the following equation: $(V\times h)/(P\times A\times t)=(28600\times 2.5)/(6\times 12.6\times 10)=95$.

Also, pressure loss when the air ventilation rate was 2 L/min. was 0.05 g/cm$^2$ from which the second degree of ventilation was calculated as follows: $(2000\times 2.5)/(0.05\times 12.6)=7937$.

A coating material 3 (80 Baume) was applied to the surface of the pattern 1 with the through-hole and dried. Then, molding was carried out according to the process shown in FIG. 1. The material of the cast iron was FC-250 and casting temperature was 1400° C. The condition during casting and the quality (condition of casting surface) of the resulting cast were evaluated.

During casting, a change in pressure on the entrance side of the exhausting path 8 provided with the spherical alumina-filled layer 9 which was the exhaust gas-controlling means was measured using a pressure gage (gage pressure) to find the second pressure loss.

The results of evaluation and the pouring time, the first pressure loss (calculated value), the second pressure loss (actual value), and the first degree of ventilation (the value calculated from the flow rate of gas extrapolated from a calibration curve) and the second degree of ventilation (calculated value at an airflow rate of 2 L/min.) of the exhaust gas-controlling means are shown in Table 1. The composition of the coating material was as follows: silica powder (average particle diameter: 8 μm): 40% by weight, vein graphite: 10% by weight, vinyl acetate type binder: 5% by weight, water: 40% by weight, nonionic surfactant: 0.5% by weight and bentonite: 4.5% by weight.

Examples 2 to 4

A casting operation was carried out in the same manner as in Example 1 except that the pouring time, the pressure loss and the degree of ventilation in the exhaust gas-controlling means were changed as shown in Table 1 and the same evaluation as in Example 1 was made. The results are shown in Table 1.

In Example 2, spherical alumina 0.5 mm in diameter was filled such that the thickness of the alumina layer was 2 cm. The pressure loss P in the exhausting path was as follows: P=0.47 g/cm$^2$ when air ventilation rate was 1 L/min., P=1.41 g/cm$^2$ when air ventilation rate was 3 L/min. and P=2.36 g/cm$^2$ when air ventilation rate was 5 L/min.

Also, in Example 3, spherical alumina 5 mm in diameter was filled such that the thickness of the alumina layer was 2 cm. The pressure loss P in the exhausting path was as follows: P=0.0033 g/cm$^2$ when air ventilation rate was 1 L/min., P=0.0099 g/cm$^2$ when air ventilation rate was 3 L/min. and P=0.0165 g/cm$^2$ when air ventilation rate was 5 L/min.

Further, in Example 4, spherical alumina 0.1 mm in diameter was filled such that the thickness of the alumina layer was 2 cm. The pressure loss P in the exhausting path was as follows: P=1.36 g/cm$^2$ when air ventilation rate was 1 L/min., P=1.72 g/cm$^2$ when air ventilation rate was 3 L/min. and P=2.22 g/cm$^2$ when air ventilation rate was 5 L/min.

Example 5

A casting operation was carried out in the same manner as in Example 1 except that a stainless fine tube having an inside diameter of 8.8 mm and a length of 600 mm was used as the exhaust gas-controlling means and no exhausting path was not installed (the fine tube is used as the exhausting path, too), and the same evaluation as in Example 1 was made. The fine tube was disposed in such a manner as to be communicated with the through-hole of the model. The pressure loss P in the exhausting path was as follows: P=0.02 g/cm$^2$ when air ventilation rate was 1 L/min., P=0.09 g/cm$^2$ when air ventilation rate was 3 L/min. and P=0.16 g/cm$^2$ when air ventilation rate was 5 L/min. The results are shown in Table 1.

Comparative Example 1

A casting operation was carried out in the same manner as in Example 1 except that the exhausting path 8 was not formed in Example 1 and the same evaluation as in Example 1 was made. The results are shown in Table 1.

Comparative Example 2

A casting operation was carried out in the same manner as in Example 1 except that no alumina ball was filled in the exhausting path and the same evaluation as in Example 1 was made. The results are shown in Table 1.

Comparative Example 3

A casting operation was carried out in the same manner as in Example 1 except that a pattern formed with no through-hole was used and the same evaluation as in Example 1 was made. The results are shown in Table 1.

The following particulars in Table 1 will be explained.

(Note 1) In Example 5 and Comparative Example 2, no alumina ball was filled and therefore the filler layer thickness was not defined, so that the degree of ventilation was not found.

(Note 2) There is no data because the exhaust gas-controlling means was not used. This Comparative Example 1 may be regarded as equal to the case using a system provided with exhaust gas-controlling means having a limitlessly large pressure drop.

(Note 3) There is no data because-the exhaust gas-controlling means was not used. This Comparative Example 1 may be regarded as equal to the case using a system provided with exhaust gas-controlling means having a limitlessly small degree of ventilation.

(Note 4) Not calculated because the amount the thermally decomposed gas passing through the exhaust gas-controlling means could not be grasped.

(Note 5) In the overall evaluation, ◎ is the best, ○, Δ and X show that the quality level descends in this order. X shows a problematic level.

It is to be noted that a slight reduction in the quality of the cast in Example 5 in which the same pressure drop as in Example 1 was observed is considered to be caused by the effect of a difference between the flow rate of the exhaust gas at the center of the fine tube and that on the wall surface since the fine tube is used.

TABLE 1

| | Casting time (second) | first pressure loss (calculated value) (g/cm$^2$) | second pressure loss (actual value) (g/cm$^2$) | first degree of ventilation (flow rate of gas based on extrapolation from a calibration curve) | second degree of ventilation (airflow rate 2L/min.) | observed Casting | quality of cast product | (Note 5 Overall evaluation |
|---|---|---|---|---|---|---|---|---|
| Example | | | | | | | | |
| 1 | 10 | 6 | 29 | 95 | 7937 | A blow-back phenomenon and the like did not occur, enabling smooth casting | carbon residue defects were observed neither on the sides nor on the upper mold surface | ◎ |

TABLE 1-continued

| | Casting time (second) | first pressure loss (calculated value) ($g/cm^2$) | second pressure loss (actual value) ($g/cm^2$) | first degree of ventilation (flow rate of gas based on extrapolation from a calibration curve) | second degree of ventilation (airflow rate 2L/min.) | observed Casting | quality of cast product | (Note 5 Overall evaluation |
|---|---|---|---|---|---|---|---|---|
| 2 | 14 | 58 | 98 | 5.6 | 338 | A blow-back phenomenon and the like did not occur, enabling smooth casting | A few carbon residue defects were observed on both sides and upper mold surface | ○~Δ |
| 3 | 7 | 0.8 | 19 | 800 | 48100 | A blow-back phenomenon and the like did not occur, enabling smooth casting | A few carbon residue defects were observed on the upper mold surface | ○ |
| 4 | 30 | 13 | 330 | 15 | 256 | A blow-back phenomenon and the like did not occur, enabling smooth casting | carbon residue defects were observed on the sides and the upper mold surface | Δ |
| 5 | 9 | 6 | 28 | (Note 1) | (Note 1) | A blow-back phenomenon and the like did not occur,but flame spurted from the end of the capillary | carbon residue defects were observed on the sides and the upper mold surface | Δ |
| Comparative example | | | | | | | | |
| 1 | 53 | (Note 2) | (Note 2) | (Note 3) | (Note 3) | The molten metal was blown back violently in the initial stage of casting | Many carbon residue defects were observed on the sides and the upper mold surface | X |
| 2 | 6 | 0.01 | Less than 0.5 | (Note 1) | (Note 1) | A brow-back phenpmenon did not occur,but the molten metal was spurted violently from the exhaust hole | A few carbon residue defects were observed the upper mold surface | X |
| 3 | 41 | (Note 4) | 8 | (Note 4) | 7937 | The molten metal was blown back violently from the gate in the initial stage of casting | Many carbon residue defects were observed on the sides the upper mold surface | X |

The invention claimed is:

1. An evaporative pattern casting process for casting a product, which comprises pouring a molten metal into a mold provided with a pattern with a through-hole, embedded in molding sand, and evaporating the pattern with the poured molten metal, exhausting the gas generated by the evaporation of the pattern to the outside of the mold through an exhausting path provided with an exhaust gas-controlling means, wherein a first pressure loss of the gas passing through the exhausting path has a calculated value of 0.05 to 5000 $g/cm^2$.

2. The evaporative pattern casting process according to claim 1, wherein a second pressure loss of the gas passing through the exhausting path has an actual value of 0.5 to 5000 $g/cm^2$.

3. The evaporative pattern casting process according to claim 1, wherein a first degree of ventilation (value calculated from the gas flow rate extrapolated from a calibration curve) of the exhaust gas-controlling means is 0.5 to 2000.

4. The evaporative pattern casting process according to claim 1, wherein a second degree of ventilation (calculated value at an airflow rate of 2 L/min.) of the exhaust gas-controlling means is 100 to 10,000,000.

5. The evaporative pattern casting process according to claim 1, wherein the exhaust gas-controlling means comprises refractory particles.

6. The evaporative pattern casting process according to claim 1, wherein the exhaust gas-controlling means comprises a back-pressure valve.

7. The evaporative pattern casting process according to claim 1, wherein, the pattern is coated with a coating material containing a refractory aggregate having a particle diameter of 10 μm or less.

8. The evaporative pattern casting process according to claim 1, wherein the generated gas is exhausted to the outside of the mold during pouring of the molten metal.

9. A method of preventing molten metal in a casting mold from being disturbed during pouring, which comprises pouring a molten metal into a mold provided with a pattern with a through-hole, embedded in molding sand, and evaporating the pattern with the poured molten metal, exhausting the gas generated by the evaporation of the pattern to the outside of the mold through an exhausting path provided with an exhaust gas-controlling means, wherein a first pressure loss of the gas passing through the exhausting path has a calculated value of 0.05 to 5000 $g/cm^2$.

10. The method according to claim 9, wherein a second pressure loss of the gas passing through the exhausting path has an actual value of 0.5 to 5000 $g/cm^2$.

11. The method according to claim 9, wherein a first degree of ventilation (value calculated from the gas flow rate extrapolated from a calibration curve) of the exhaust gas-controlling means is 0.5 to 2000.

12. The method according to claim 9, wherein a second degree of ventilation (calculated value at an airflow rate of 2 L/min.) of the exhaust gas-controlling means is 100 to 10,000,000.

13. The method according to claim 9, wherein the exhaust gas-controlling means comprises refractory particles.

14. The method according to claim 9, wherein the exhaust gas-controlling means comprises a back-pressure valve.

15. The method according to claim 9, wherein, the pattern is coated with a coating material containing a refractory aggregate having a particle diameter of 10 μm or less.

16. The method according to claim 9, wherein the generated gas is exhausted to the outside of the mold during pouring of the molten metal.

* * * * *